US010768552B2

(12) United States Patent
Sakamaki et al.

(10) Patent No.: US 10,768,552 B2
(45) Date of Patent: Sep. 8, 2020

(54) DEVELOPING DEVICE

(71) Applicant: CANON KABUSHIKI KAISHA, Tokyo (JP)

(72) Inventors: Tomoyuki Sakamaki, Tokyo (JP); Yuta Okuyama, Matsudo (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/051,763

(22) Filed: Aug. 1, 2018

(65) Prior Publication Data

US 2018/0341198 A1 Nov. 29, 2018

Related U.S. Application Data

(63) Continuation of application No. PCT/JP2017/010289, filed on Mar. 8, 2017.

(51) Int. Cl.
*G03G 15/09* (2006.01)
*G03G 15/08* (2006.01)

(52) U.S. Cl.
CPC ..... *G03G 15/0914* (2013.01); *G03G 15/0812* (2013.01); *G03G 15/0921* (2013.01); *G03G 2215/0609* (2013.01); *G03G 2215/0634* (2013.01)

(58) Field of Classification Search
CPC ..... G03G 15/0812; G03G 15/0914; G03G 15/0921; G03G 2215/0634
See application file for complete search history.

(56) References Cited

U.S. PATENT DOCUMENTS

| | | | |
|---|---|---|---|
| 6,546,222 | B2 | 4/2003 | Sakemi et al. |
| 6,978,108 | B2 | 12/2005 | Sakamaki |
| 7,440,718 | B2 | 10/2008 | Hagiwara et al. |
| 7,454,149 | B2 | 11/2008 | Sakamaki |
| 7,561,838 | B2 | 7/2009 | Sakamaki et al. |

(Continued)

FOREIGN PATENT DOCUMENTS

| | | | |
|---|---|---|---|
| EP | 0 031 503 | A2 | 7/1981 |
| EP | 0 349 326 | A2 | 1/1990 |

(Continued)

OTHER PUBLICATIONS

Machine Translation of JP 2002-304059 A obtained on May 15, 2019 (Year: 2002).*

(Continued)

*Primary Examiner* — Gregory H Curran
(74) *Attorney, Agent, or Firm* — Venable LLP

(57) ABSTRACT

A developing device includes a rotatable developing sleeve to carry and feed a developer including toner and a carrier toward a developing region, and a magnetic field generating portion provided inside the developing sleeve and having a developing magnetic pole for forming the developing region. The developing magnetic pole is disposed opposite to a closest position of the image bearing member to the developing sleeve. A ratio of an 80%-value-width of magnetic flux density of the developing magnetic pole with respect to a normal direction of the developing sleeve to a half peak width of the magnetic flux density of the developing magnetic pole with respect to the normal direction is 0.65 or more.

11 Claims, 7 Drawing Sheets

(56) References Cited

U.S. PATENT DOCUMENTS

| | | | | |
|---|---|---|---|---|
| 7,773,900 | B2 | 8/2010 | Sakamaki | |
| 8,934,819 | B2 | 1/2015 | Sakamaki et al. | |
| 9,223,252 | B2 | 12/2015 | Sakamaki et al. | |
| 9,335,666 | B2 | 5/2016 | Sakamaki | |
| 9,442,428 | B2 | 9/2016 | Sakamaki et al. | |
| 2004/0126145 | A1* | 7/2004 | Kurosu | G03G 15/09 399/267 |
| 2014/0029986 | A1 | 1/2014 | Maruyama et al. | |

FOREIGN PATENT DOCUMENTS

| | | | | |
|---|---|---|---|---|
| JP | H04-109276 | A | | 4/1992 |
| JP | H06-149060 | A | | 5/1994 |
| JP | H06-222675 | A | | 8/1994 |
| JP | H08-146668 | A | | 6/1996 |
| JP | 10039620 | A | * | 2/1998 |
| JP | 2001-034067 | A | | 2/2001 |
| JP | 2002-304059 | A | | 10/2002 |
| JP | 2003-345136 | A | | 12/2003 |
| JP | 2004-109701 | A | | 4/2004 |
| JP | 2006-145659 | A | | 6/2006 |
| JP | 2006-208807 | A | | 8/2006 |
| JP | 2009-092883 | A | | 4/2009 |

OTHER PUBLICATIONS

Machine translation of JP 10-039620 A, obtained on May 15, 2019 (Year: 1998).*

PCT International Search Report and the Written Opinion dated May 9, 2017, in PCT/JP2017/010289.

Korean Office Action dated Jul. 30, 2019, in related Korean Patent Application No. 10-2018-7027788.

European Search Report dated Oct. 15, 2019, in related European Patent Application No. 17763457.3.

* cited by examiner (a)

(b)

(a)

(b)

DEVELOPING DEVICE

This application is a continuation of PCT Application No. PCT/JP2017/010289, filed on Mar. 8, 2017.

TECHNICAL FIELD

The present invention relates to a developing device for use with an image forming apparatus of an electrophotographic type, an electrostatic recording type, or the like, and particularly relates to a developing device using a two-component developer which is a mixture of non-magnetic toner and a magnetic carrier.

BACKGROUND ART

A conventional image forming apparatus of the electrophotographic type has been widely used as a copying machine, a printer, a plotter, a facsimile machine, a multifunction machine having a plurality of functions of these machines, and the like. In the image forming apparatus of this type, charged toner is brought near to a photosensitive drum and is electrostatically deposited on an electrostatic latent image on the photosensitive drum, and thus development is carried out, so that an image is formed. As a developing type, in addition to a developing type using a one-component developer, as a developer, consisting of magnetic toner, a developing type using the two-component developer in which the non-magnetic toner and the magnetic carrier are mixed with each other has also become widespread. According to the developing type using the two-component developer, this developing type is excellent in stability of a toner charge amount and therefore it is possible to form a color image excellent in color tint, and particularly, the developing type is suitably applied to an image forming apparatus of a color image.

In the developing type using the two-component developer, the developer is carried on a developing sleeve by a magnet (magnetic field generating means) fixedly provided in the developing sleeve and the magnetic carrier forms magnetic chains along magnetic lines of force of the magnetic field generating means. When the developer is fed to a region in which the developing sleeve is close to the photosensitive drum, the magnetic chains contact the photosensitive drum. Thereafter, the magnetic chains are separated from through a region in which the developing sleeve is closest to the photosensitive drum. This region from contact of the magnetic chains with the photosensitive drum to separation of the magnetic chains from the photosensitive drum is a contact nip, and herein, this contact nip is referred to as a developing region. Further, principally in this region, the toner is deposited on the electrostatic latent image by a force of an electric field generated by a potential difference between the developing sleeve and the electrostatic latent image on the photosensitive drum, so that a toner image is formed.

In the developing type using the two-component developer, it is important that a toner development amount per potential difference between an exposure potential on the photosensitive drum and the developing sleeve, i.e., a so-called developing efficiency is increased. When the developing efficiency is low, there is a need that in order to provide a sufficient image density, the potential difference between the exposure potential and the developing sleeve is made larger and thus the electric field strength is enhanced and thereby to increase the toner development amount. However, when the electric field strength is excessively enhanced, there is a liability that the carrier of the two-component developer is deposited together with the toner on the photosensitive drum. The carrier deposited on the photosensitive drum impairs transfer of the toner and causes an occurrence of white dropout (white void) on an image. For that reason, there is a need to increase the toner development amount without enhancing the electric field strength.

As a method of enhancing the developing, there is a method of extending a developing region. In order to extend the developing region, in the region in which the developing sleeve is close to the photosensitive drum, an erected chain region of the developer may only be required to be increased. In order to increase the erected chain region of the developer, a developing device in which a half peak width of a developing magnetic pole, opposing the photosensitive drum, of a plurality of magnetic poles constituting the magnetic field generating means fixedly disposed in the developing sleeve is made large has been known (Japanese Laid-Open Patent Application (JP-A) 2001-34067).

SUMMARY OF THE INVENTION

Problem to be Solved by the Invention

However, in the above-described developing device of JP-A 2001-34067, in magnetic flux density which is, for example, a normal distribution of the developing magnetic pole, the half peak width of the developing magnetic pole was simply made large and the developing region was only increased, and therefore, linearity of the magnetic lines of force in the developing region was not taken into consideration. For this reason, in an upstream portion and a downstream portion of the developing region with respect to a rotational direction, the magnetic lines of force are curved along a surface of the photosensitive drum and contact the photosensitive drum in a state in which free ends of the magnetic chains are inclined along the surface of the photosensitive drum. By this, the toner jumping from the developing sleeve side toward the photosensitive drum side is deposited on the magnetic chains, with which the toner is in contact, along the surface of the photosensitive drum, so that there was a liability that development on the photosensitive drum was impaired and thus the developing efficiency was not improved.

An object of the present invention is to provide a developing device capable of suppressing a lowering in developing efficiency by controlling a contact state of free ends of magnetic chains with a photosensitive drum even while extending a developing region.

Means for Solving the Problem

According to an aspect of the present invention, there is provided a developing device comprising: a rotatable developing sleeve for carrying a developer including toner and a magnetic carrier and for developing an electrostatic latent image, formed on an image bearing member, in a developing region where the developer contacts the image bearing member; and a magnetic field generating portion provided inside the developing sleeve and having a developing pole provided at a position opposing the image bearing member in order to form the developing region, wherein a ratio of an 80%-value-width of magnetic flux density of the developing pole with respect to a normal direction of the developing sleeve to a half peak width of the magnetic flux density of the developing magnetic pole with respect to the normal direction is 0.65 or more, and with respect to a rotational direction of the developing sleeve, a magnetic force of the developing pole in the normal direction of the developing sleeve in each of neighborhoods of both end portions of the developing region is larger than a magnetic force of the developing pole at a central portion of the developing region.

According to another aspect of the present invention, there is provided a developing device comprising: a rotatable developing sleeve for carrying a developer including toner and a magnetic carrier and for developing an electrostatic latent image, formed on an image bearing member, in a developing region where the developer contacts the image bearing member; a magnetic field generating portion provided inside the developing sleeve and having a developing pole provided at a position opposing the image bearing member in order to form the developing region, and a voltage source for applying a DC voltage to the developing sleeve, wherein the electrostatic latent image on the image bearing member is developed by applying the DC voltage to the developing sleeve without applying an AC voltage to the developing sleeve, wherein a ratio of an 80%-value-width of magnetic flux density of the developing pole with respect to a normal direction of the developing sleeve to a half peak width of the magnetic flux density of the developing magnetic pole with respect to the normal direction is 0.65 or more.

According to a further aspect of the present invention, there is provided a developing device comprising: a rotatable developing sleeve for carrying a developer including toner and a magnetic carrier and for developing an electrostatic latent image, formed on an image bearing member, in a developing region where the developer contacts the image bearing member; and a magnetic field generating portion provided inside the developing sleeve and having a first pole provided at a position opposing the image bearing member in order to form the developing region, a second pole provided upstream of the first pole at a position adjacent to the first pole with respect to a rotational direction of the developing sleeve, and a third pole provided downstream of the first pole at a position adjacent to the first pole with respect to the rotational direction of the developing sleeve, wherein a ratio of an 80%-value-width of magnetic flux density of the developing pole with respect to a normal direction of the developing sleeve to a half peak width of the magnetic flux density of the developing magnetic pole with respect to the normal direction is 0.65 or more, and each of an angle formed by a peak of the magnetic flux density of the first pole and a peak of the magnetic flux density of the second pole and an angle formed by the peak of the magnetic flux density of the first pole and a peak of the magnetic flux density of the third pole is 90° or less.

Effect of the Invention

According to the present invention, it is possible to suppress the lowering in developing efficiency by controlling the contact state of the free ends of the magnetic chains with the photosensitive drum even while extending the developing region.

Figure 8:
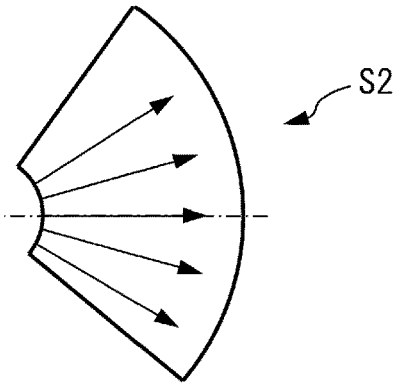
Figure 8:
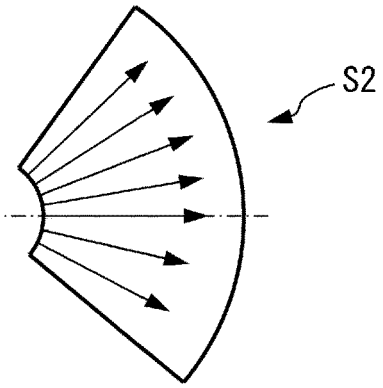

Parts (a) and (b) of FIG. 8 are illustrations of magnetic pieces of a developing magnetic pole, in which part (a) is the magnetic piece subjected to conventional symmetric magnetization, and part (b) is the magnetic piece subjected to asymmetric magnetization according to the embodiment.

Figure 9:
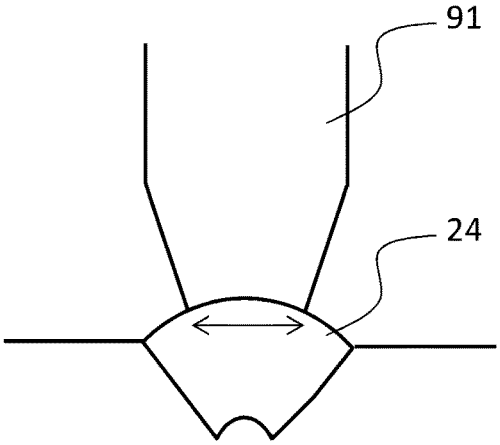

FIG. 9 shows a conventional magnetizing method.

EMBODIMENTS FOR CARRYING OUT THE INVENTION

In the following, a developing device in an embodiment of the present invention will be specifically described with reference to FIGS. 1 to 7. In this embodiment, the case where the developing device is applied to, as an example of an image forming apparatus, a full-color printer of a tandem type is described. However, the developing device of the present invention is not limited to the developing device of the image forming apparatus of the tandem type but may also be a developing device of an image forming apparatus of another type. Further, the developing device is not limited to the developing device for a full-color image, but may also be a developing device for a monochromatic image or a developing device for a mono-color (single color) image. Or, the developing device can be carried out in various uses, such as printers, various printing machines, copying machines, facsimile machines and multi-function machines by adding necessary devices, equipment and casing structures or the like. Further, in this embodiment, an image forming apparatus 1 is of a type in which an intermediary transfer belt 44*b* is provided and toner images of respective colors are primary-transferred from photosensitive drums 81 onto the intermediary transfer belt 44*b* and thereafter composite toner images of the respective colors are secondary-transferred altogether from the intermediary transfer belt 44*b* onto a sheet S. However, the image forming apparatus is not limited thereto, but may also employ a type in which a toner image is directly transferred from a photosensitive drum onto a sheet fed by a sheet feeding belt.

Further, in this embodiment, as a developer, a two-component developer consisting of non-magnetic toner and a magnetic carrier is used. The toner is formed by incorporating a colorant, a wax component and the like in a resin material such as polyester or styrene through pulverization or polymerization. The carrier is formed by subjecting a surface layer of a core consisting of resin particles, with which ferrite particles or magnetic powder is kneaded, to resin coating.

Figure 1:
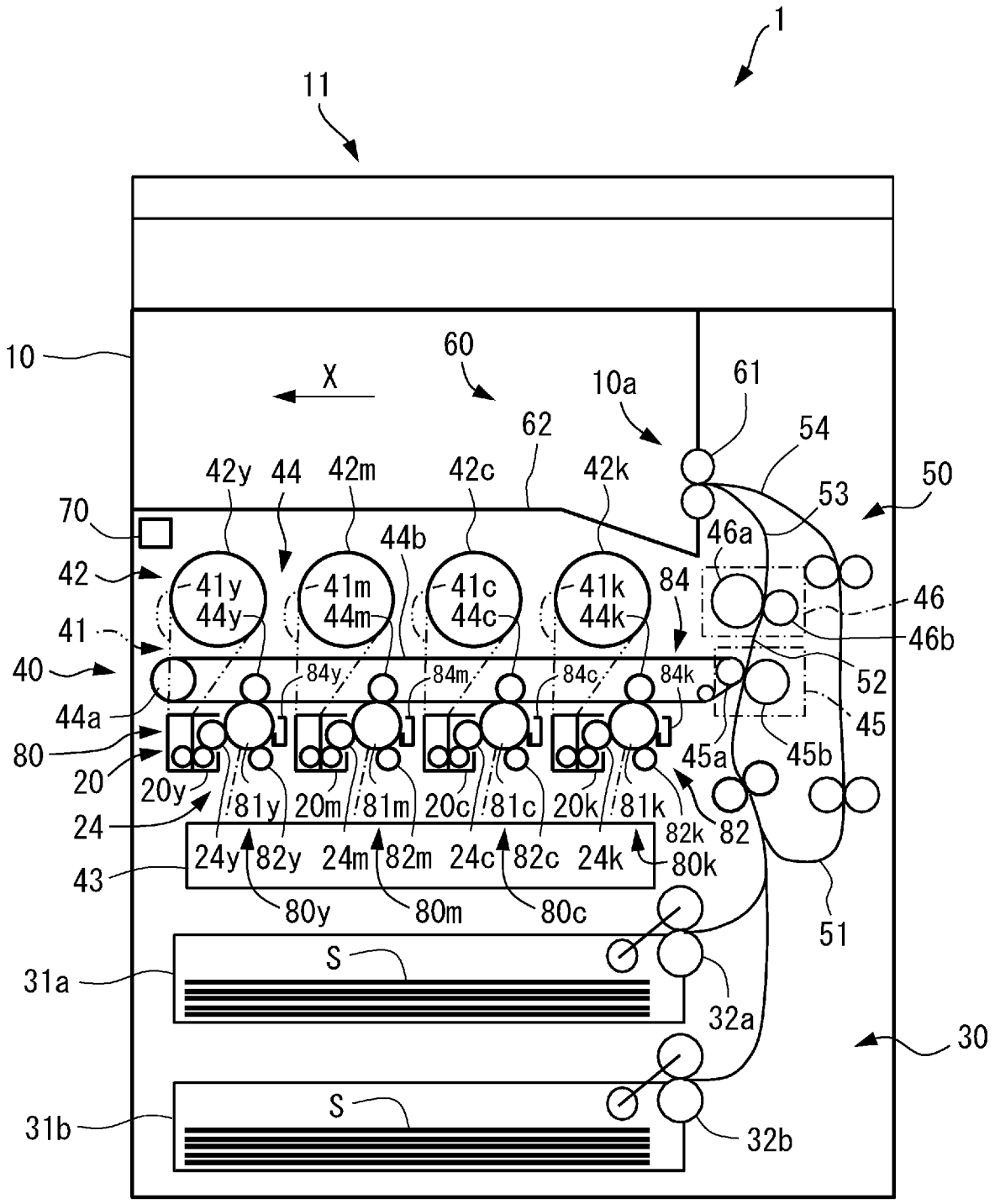
FIG. 1 is a sectional view showing a schematic structure of an image forming apparatus according to an embodiment.

As shown in FIG. 1, the image forming apparatus 1 includes an image forming apparatus main assembly (hereinafter, referred to as an apparatus main assembly) 10 as a casing. The apparatus main assembly 10 includes an image reading portion 11, a sheet feeding portion 30, an image forming portion 40, a sheet feeding (conveying) portion 50, a sheet discharging portion 60, and a controller 70. On the sheet S as a recording material, the toner image is to be formed, and specific examples of the sheet S may include plain paper, a resin-made material sheet as a substitute for the plain paper, thick paper, a sheet for an overhead projector, and the like.

The image reading portion 11 is provided at an upper portion of the apparatus main assembly. The image reading portion 11 includes an unshown platen glass as an original mounting table, an unshown light source for irradiating an original, placed on the platen glass, with light, and an unshown image sensor for converting reflected light into a digital signal, and the like member.

The sheet feeding portion 30 is disposed at a lower portion of the apparatus main assembly 10, and includes sheet cassettes 31*a* and 31*b* for stacking and accommodating the sheets S such as recording paper and includes feeding rollers 32*a* and 32*b*, and feeds the accommodated sheet S to the image forming portion 40.

The image forming portion 40 includes image forming units 80, toner hoppers 41, toner containers 42, a laser scanner 43, an intermediary transfer unit, a secondary transfer portion 45 and a fixing device 46. The image forming portion 40 is capable of forming an image on the sheet S on the basis of image information. Incidentally, the image forming apparatus 1 in this embodiment meets full-color image formation, and the image forming units 80*y*, 80*m*, 80*c*, 80*k* have similar constitutions for four colors of yellow (y), magenta (m), cyan (c), black (k), respectively, and are separately provided. Also the toner hoppers 41*y*, 41*m*, 41*c*, 41*k* and the toner containers 42*y*, 42*m*, 42*c*, 42*k* similarly have the same constitution for the four colors of yellow (y), magenta (m), cyan (c), black (k), respectively, and are separately provided. For this reason, in FIG. 1, respective constituent elements for the four colors are represented by identifiers for the colors, but in FIG. 2 and in the specification, are described using only reference numerals or symbols without adding the identifiers for the colors in some cases.

The toner containers 42 are, for example, cylindrical bottles, and the toners are accommodated, and above the respective image forming unit 80, the toner container 42 is connected and disposed through the toner hopper 41. The laser scanner 43 exposes the surface of the photosensitive drum 81, electrically charged by the charging roller 82, to light and thus electrostatic latent image is formed on the surface of the photosensitive drum 81.

The image forming unit 80 includes the four image forming units 80*y*, 80*m*, 80*c*, 80*k* for forming toner images of the four colors. Each image forming unit 80 includes the photosensitive drum 81 (image bearing member) for forming the toner image, a charging roller 82, a developing device 20 and a cleaning blade 84. Further, the photosensitive drum 81, the charging roller 82, the developing device 20, the cleaning blade 84 and a developing sleeve 24 described later have the same constitution for the four colors of yellow (y), magenta (m), cyan (c), black (k), respectively, and are separately provided.

The photosensitive drum 81 includes a photosensitive layer formed on an outer peripheral surface of an aluminum cylinder so as to have a negative charge polarity, and is rotated in an arrow direction at a predetermined process speed (peripheral speed). The charging roller 82 contacts the surface of the photosensitive drum 81 and electrically charges the surface of the photosensitive drum 81 to, e.g., a uniform negative dark-portion potential. After the charging, at each of the respective surfaces of the photosensitive drums 81, an electrostatic image is formed on the basis of image information by the laser scanner 43. Each of the photosensitive drums 81 carries the formed electrostatic image and is circulated and moved, and the electrostatic image is developed with the toner by the developing device 20. Details of a structure of the developing device 20 will be described later.

The toner image obtained by developing the electrostatic image is primary-transferred onto the intermediary transfer belt 44*b* described later. The surface of the photosensitive drum 81 after the primary transfer is discharged by an unshown pre-exposure portion. The cleaning blade 84 is disposed in contact with the surface of the photosensitive drum 81 and removes a residual matter such as transfer residual toner remaining on the surface of the photosensitive drum 81 after the primary transfer.

The intermediary transfer unit 44 is disposed above the image forming units 80*y*, 80*m*, 80*c* and 80*k*. The intermediary transfer unit 44 includes a driving roller 44*a*, a follower roller 44*d*, a plurality of primary transfer rollers 44*y*, 44*m*, 44*c* and 44*k*, and the intermediary transfer belt 44*b* wound around these rollers. The primary transfer rollers 44*y*, 44*m*, 44*c* and 44*k* are disposed opposed to the photosensitive drums 81, 81*m*, 81*c* and 81*k*, respectively, and are disposed in contact with the intermediary transfer belt 44*b*.

A positive-polarity transfer bias is applied to the intermediary transfer belt 44*b* by the primary transfer rollers 44*y*, 44*m*, 44*c* and 44*k*, whereby toner images having the negative polarity are superposedly transferred successively from the photosensitive drums 81*y*, 81*m*, 81*c* and 81*k* onto the intermediary transfer belt 44*b*. By this, the toner images obtained by developing the electrostatic images on the surfaces of the photosensitive drums 81*y*, 81*m*, 81*c* and 81*k* are transferred on the intermediary transfer 44*b*, and the intermediary transfer belt 44*b* moves.

The secondary transfer portion 45 includes a secondary transfer inner roller 45*a* and a secondary transfer outer roller 45*b*. By applying a positive-polarity secondary transfer bias to the secondary transfer outer roller 45*b*, the full-color image formed on the intermediary transfer belt 44*b* is transferred onto the sheet S. The fixing device 46 includes a fixing roller 46*a* and a pressing roller 46*a*. The sheet S is nipped and fed between the fixing roller 46*a* and the pressing roller 46*b*, so that the toner image transferred on the sheet S is pressed and heated and thus is fixed on the sheet S.

The sheet feeding portion 50 includes a pre-secondary transfer feeding path 51, a pre-fixing feeding path 52, a discharging path 53, a re-feeding path 54, and feeds the sheet S, fed from the sheet feeding portion 30, from the image forming portion 40 to the sheet discharging portion 60.

The sheet discharging portion 60 includes a discharging roller pair 61 provided in a downstream side of a discharging path 53, a discharge tray 62 provided on a side downstream of the discharging roller pair 61. The discharging roller pair 61 feeds the sheet S fed from the discharging path 53 through a nip thereof, and discharges the sheet S to the discharge tray 62 through a discharge opening 10*a* formed on the apparatus main assembly 10. The discharge tray 62 is a face-down tray, and the sheet S discharged through the discharge opening 10*a* in an arrow X direction is stacked on the discharge tray 62.

The controller 70 is constituted by a computer and, e.g., includes a CPU, an ROM for storing a program for controlling respective portions, an RAM for temporarily storing data, and an input-and-output circuit for inputting and outputting signals relative to an external device. The CPU is a microprocessor for effecting entire control of the image forming apparatus 1 and is a principal part of a system controller. The CPU is connected via the input-and-output circuit with each of the image recording portion 11, the sheet feeding portion 30, the image forming portion 40, the sheet feeding portion 50, the sheet discharging portion 60 and an operating portion, and transfers signals with the respective portions and controls operations of the respective portions.

Next, an image forming operation in the image forming apparatus 1 constituted as described above will be described.

When the image forming operation is started, first, the photosensitive drum 81 is rotated, and the surface thereof is electrically charged by the charging roller 82. Then, the laser scanner 43 emits, on the basis of image information, a laser beam toward the surface of the photosensitive drum 81, so that the electrostatic latent image is formed on the surface of the photosensitive drum 81. The toner is deposited on the electrostatic latent image, so that the electrostatic latent image is developed (visualize) into a toner image, and then the toner image is transferred onto the intermediary transfer belt 44*b*.

On the other hand, in parallel to such a toner image forming operation, the feeding rollers 32*a* and 32*b* are rotated and feed the uppermost sheets S in the sheet cassettes 31*a* and 31*b* while separating the sheets S. Then, each of the sheets S is fed to the secondary transfer portion 45 via the pre-secondary transfer feeding path 51 by being timed to the toner image on the intermediary transfer belt 44*b*. Then, the toner image is transferred from the intermediary transfer belt 44*b* onto the sheet S, and the sheet S is fed into the fixing device 46, in which the unfixed toner image is heated and pressed, thus is fixed on the surface of the sheet S. The sheet S is discharged through the discharge opening 10*a* by the discharging roller pair 61, and is stacked on the discharge tray 62.

Figure 2:
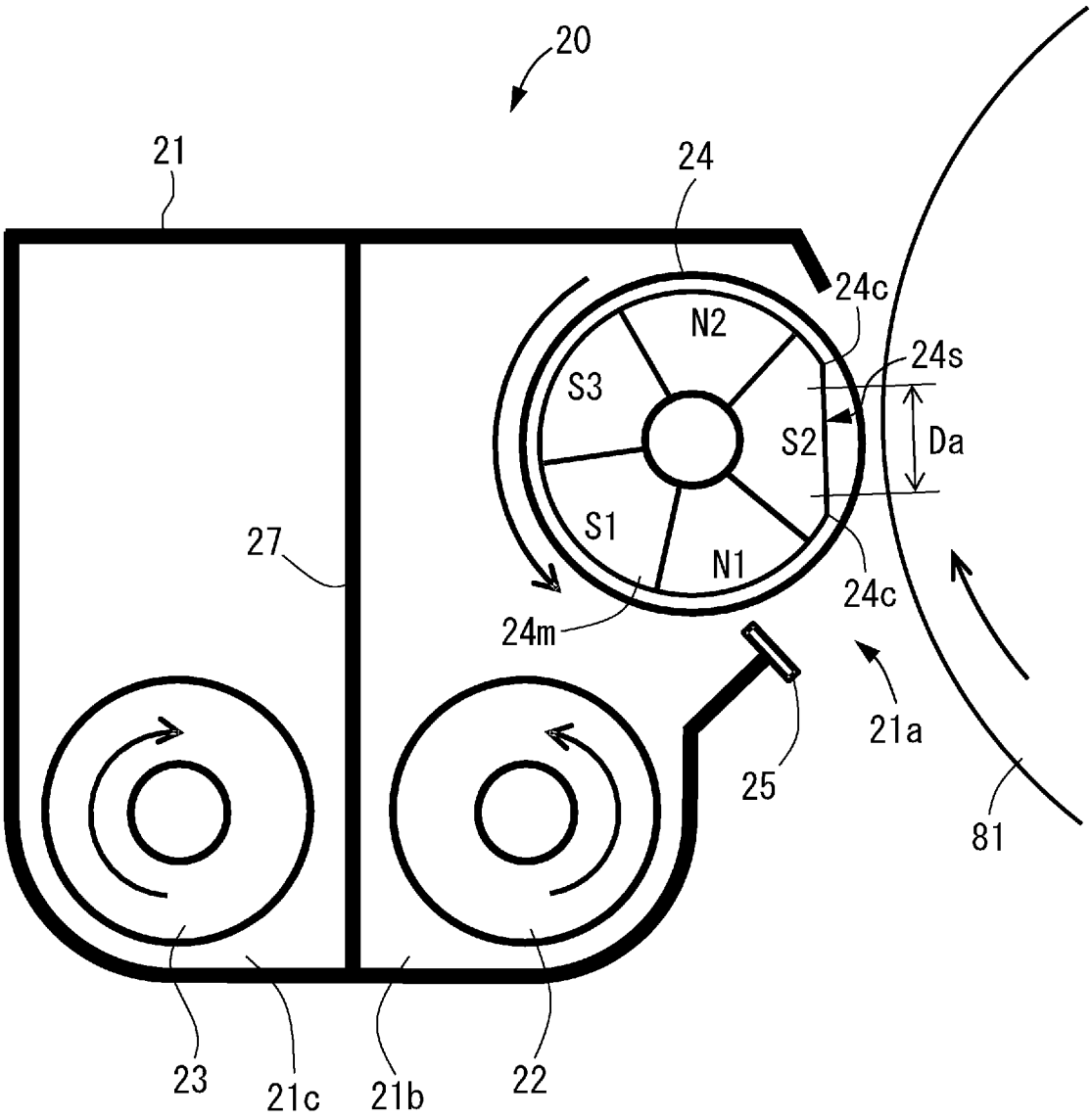
FIG. 2 is a sectional view showing a schematic structure of a developing device according to the embodiment.

Next, the developing device 20 will be specifically described with reference to FIG. 2. The developing device 20 includes a developing (developer) container 21 accommodating the developer, a first screw 22 and a second feeding screw 23, the developing sleeve 24, and a regulating member 25. The developing container 21 is provided with an opening 21*a* where the developing sleeve 24 is exposed at a position opposing the photosensitive drum 81.

Into the developing container 21, the toner is supplied from the toner container 42 (FIG. 1) in which the toner is filled. The developing container 21 includes a partition wall 27 extending in a longitudinal direction substantially at a central portion. The developing container 21 is partitioned by the partition wall 27 into a developing chamber 21*b* and a stirring chamber 21*c* with respect to a horizontal direction. The developer is accommodated in the developing chamber 21*b* and the stirring chamber 21*c*. In the developing chamber 21*b*, the developer is fed to the developing sleeve 24. The stirring chamber 21*c* communicates with the developing chamber 21*b*, and the developer is collected from the developing sleeve 24 and is stirred.

The first feeding screw 22 is disposed in the developing chamber 21*b* along an axial direction of the developing sleeve 24 and substantially parallel with the developing sleeve 24. The second feeding screw 23 is disposed in the stirring chamber 21*c* substantially parallel with a shaft of the first feeding screw 22, and feeds the developer in the stirring chamber 21*c* in a direction opposite to a feeding direction of the first feeding screw 22. That is, the developing chamber 21*b* and the stirring chamber 21*c* constitute a circulation path of the developer along which the developer is fed while being stirred. The toner is triboelectrically charged to the negative polarity through sliding with the carrier by being stirred by the respective screws 22 and 23.

The developing sleeve 24 carries the developer including the non-magnetic toner and the magnetic carrier and rotationally feeds the developer to a developing region Da opposing the photosensitive drum 81. A range in which magnetic chains formed by the carrier on the surface of the developing sleeve 24 contact the photosensitive drum 81 is a contact nip, and in this embodiment, this contact nip is the developing region Da (part (a) of FIG. 5). That is, the developing region Da is a region where the magnetic chains carried on the developing sleeve 24 contact the photosensitive drum 81.

The developing sleeve 20 is 20 mm in diameter, for example, and has a cylindrical shape, and is constituted by a non-magnetic material such as aluminum or non-magnetic stainless steel, and is formed in this embodiment by aluminum. Further, in this embodiment, the shortest interval (gap) in the developing region Da is about 320 μm. By this, the interval is set so that the developer fed to the developing region Da is contacted to the photosensitive drum 81 in a magnetic chain state and thus development can be carried out. That is, in the developing type using the two-component developer, the magnetic carrier is constrained by magnetic flux of a magnet roller 24*m* during the development and is carried on the surface of the developing sleeve 24. On the surface of the developing sleeve 24, the negatively charged toner is electrostatically constrained by the surface of the positively charged carrier, so that the magnetic chain is formed. Then, the latent image is visualized by providing a potential difference between a DC voltage applied to the developing sleeve 24 and the electrostatic latent image on the photosensitive drum 81 and then by causing the toner to jump to the photosensitive drum 81.

That is, the developer in the developing container 21 is carried on the developing sleeve 24 by the magnet roller 24*m* fixedly disposed inside the developing sleeve 24. Thereafter, a layer thickness of the developer on the developing sleeve 24 is regulated by the regulating member 25, and the developer is fed to the developing region Da opposing the photosensitive drum 81 by rotation of the developing sleeve 24. In the developing region Da, the developer is erected and forms magnetic chains. The magnetic chains are contacted to the photosensitive drum 81, so that the toner is supplied to the photosensitive drum 81 and thus the electrostatic latent image on the photosensitive drum 81 is developed as the toner image.

Here, a developing step of developing the electrostatic latent image into the toner image on the photosensitive drum 81 in the developing region Da will be described. The photosensitive drum 81 is electrically charged uniformly to a charge potential Vd(V) by the charging roller 82, and thereafter, an image portion is exposed to light and has an exposure potential Vl(V). To the developing sleeve 24, in order to improve a ratio of impartation of the toner to the electrostatic latent image, a developing bias in a superposed form of a DC voltage and an AC voltage is applied in general. When a voltage of a DC component of the developing sleeve 24 is Vdc, an absolute value |Vdc−Vl| of a difference between the DC voltage Vdc and the exposure potential is called Vcont, and this forms an electric field for carrying the toner to the image portion. Incidentally, an absolute value |Vdc−Vd| of a difference between the DC voltage Vdc and the charge potential Vd is called Vback, and this form forms an electric field for pulling back the toner in a direction from the photosensitive drum 81 to the developing sleeve 24. This is provided for suppressing a so-called fog phenomenon that the toner deposits on a non-image portion. In this embodiment, a DC development type in which to the developing sleeve 24, the AC voltage is not applied and only the DC voltage is applied is used.

The regulating member 25 opposes a regulating magnetic pole N1 of the magnet roller 24*m* and is provided on the developing container 21. The regulating member 25 is fixed to the developing container 21 in a state in which a free end thereof is spaced from the developing sleeve 24 with a predetermined interval, and regulates a layer thickness of the developer by cutting of the magnetic chain of the developer carried on the surface of the developing sleeve 24. The regulating member 25 is consisting of a non-magnetic metal plate (for example, an aluminum plate) disposed along a longitudinal direction of the developing sleeve 24, and passes through between a free end portion of the regulating member 25 and the developing sleeve 24 and is sent to the developing region Da.

Inside the developing sleeve 24, a roller-shaped magnet roller (magnetic field generating means) 24*m* is fixedly provided to the developing container 21 in a non-rotatable state. The magnet roller 24*m* includes five magnetic pieces each having a magnetic pole opposing the developing sleeve 24. In this embodiment, the magnet roller 24*m* includes a developing magnetic pole S2 (first magnetic pole), the regulating magnetic pole N1 (second magnetic pole), a feeding magnetic pole N2 (third magnetic pole), a peeling magnetic pole S3 (fourth magnetic pole), and a scooping magnetic pole S1 (fifth magnetic pole).

The scooping magnetic pole S1 is disposed opposed to the developing chamber 21*b*. The developing magnetic pole N1 is disposed opposed to the regulating member 25. The feeding magnetic pole N2 is disposed on a side downstream of the developing region Da with respect to the rotational direction. The peeling magnetic pole S3 is disposed adjacent to and upstream of the scooping magnetic pole S1 with respect to the rotational direction.

The developing magnetic pole S2 is disposed opposed to the developing region Da. Incidentally, in this embodiment, the magnet roller 24*m* applies, as the developing magnetic pole S2, a magnetic piece having only one peak of a magnetic flux density Br. Incidentally, that as the developing magnetic pole S2, the magnetic piece having only one peak of the magnetic flux density Br is applied means a constitution in which a single (one) peak of Br is in a region, sandwiched by reverse positions where a polarity of the magnetic flux density Br is reversed (inverted), between the regulating magnetic pole N1 adjacent to the developing magnetic pole S2 and the feeding magnetic pole N2. The region, sandwiched by the reverse positions where the polarity of the magnetic flux density Br is reversed, between the regulating magnetic pole N1 and the feeding magnetic pole N2 corresponds to a range from 260° to 320° in FIG. 3, for example.

The developing magnetic pole S2 includes a planar flat surface portion 24*s* opposing the developing region Da. That is, the magnet roller 24*m* has a so-called D-cut shape in cross-section as a whole, and the magnetic piece including the developing magnetic pole S2 has a substantially sector shape in cross-section. Both end portions of the first surface portion 24*s* with respect to the rotational direction form corner portions 24*c*. That is, the region magnetic pole S2 includes the corner portions 24*c* at positions opposing the photosensitive drum 81 on sides upstream and downstream of the developing region Da with respect to the rotational direction at an outer peripheral surface of the developing sleeve 24 and includes the flat surface portion 24*s* between the respective corner portions 24*c*. By this, portions where a change in θ direction of the magnetic flux density Br is large and peaks of Br exist can be provided on the sides upstream and downstream of the developing region Da, and also peaks of a magnetic attraction force Fr can be provided on the sides upstream and downstream of the developing region Da. For this reason, in the developing region Da, the magnetic attraction force Fr can be maintained at a high value (see, Embodiments 1 and 2 in FIG. 6), and the magnetic chains are firmly constrained by the developing sleeve 24, and therefore, the magnetic chains do not readily slip on the developing sleeve 24, so that a lowering in speed of the magnetic chains can be suppressed.

Figure 6:
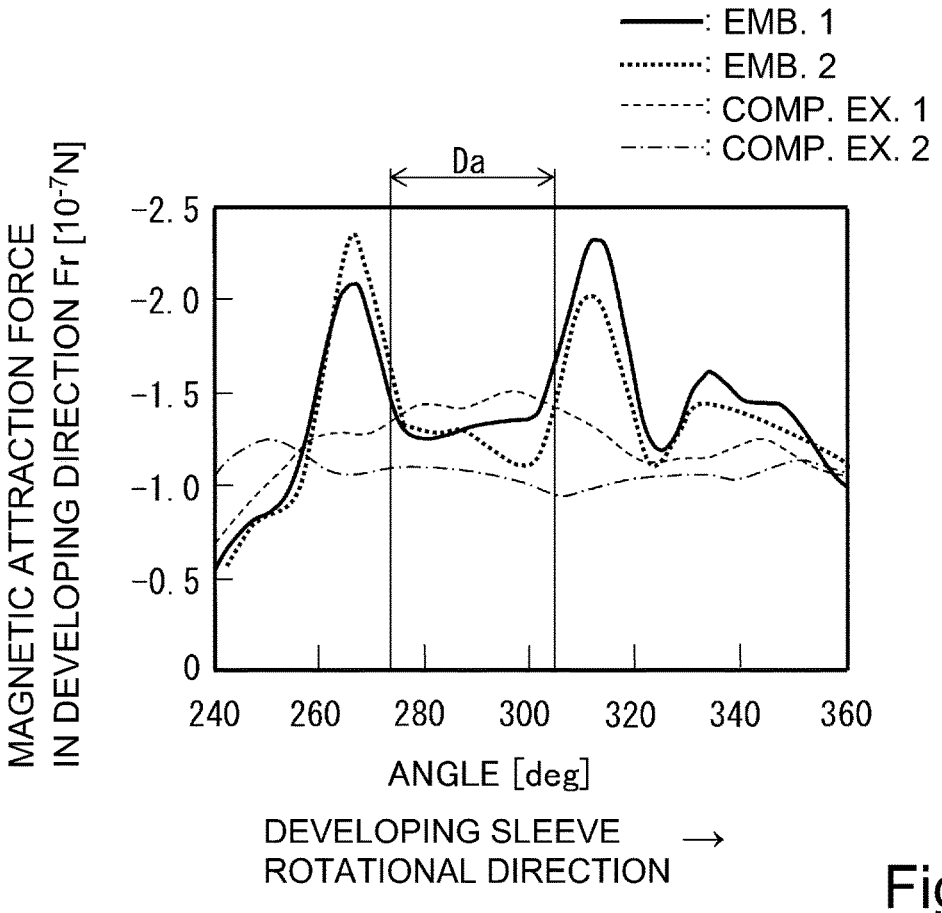
FIG. 6 is an illustration showing a relationship between an angle with a developing region of a developing sleeve as a center and a magnetic attraction force in a developing sleeve direction according to Embodiments 1 and 2 and Comparison Examples 1 and 2.

That is, the developing magnetic pole S2 has peaks of the magnetic attraction force Fr toward a center direction of the developing sleeve 24 at portions opposing the photosensitive drum 81 on sides upstream and downstream of the developing region Da with respect to the rotational direction at the outer peripheral surface of the developing sleeve 24 (see, Embodiments 1 and 2 in FIG. 6). Incidentally, that the developing magnetic pole S has the peaks of the magnetic attraction force Fr toward the center direction of the developing sleeve 24 means the following constitution. That is, it means a constitution in which between the regulating magnetic pole N1 adjacent to the developing magnetic pole S2 and the feeding magnetic pole N2, the developing magnetic pole S2 has the peaks of the magnetic attraction force Fr in a developing sandwiched by reverse positions where the polarity of the magnetic flux density Br is reversed.

Figure 3:
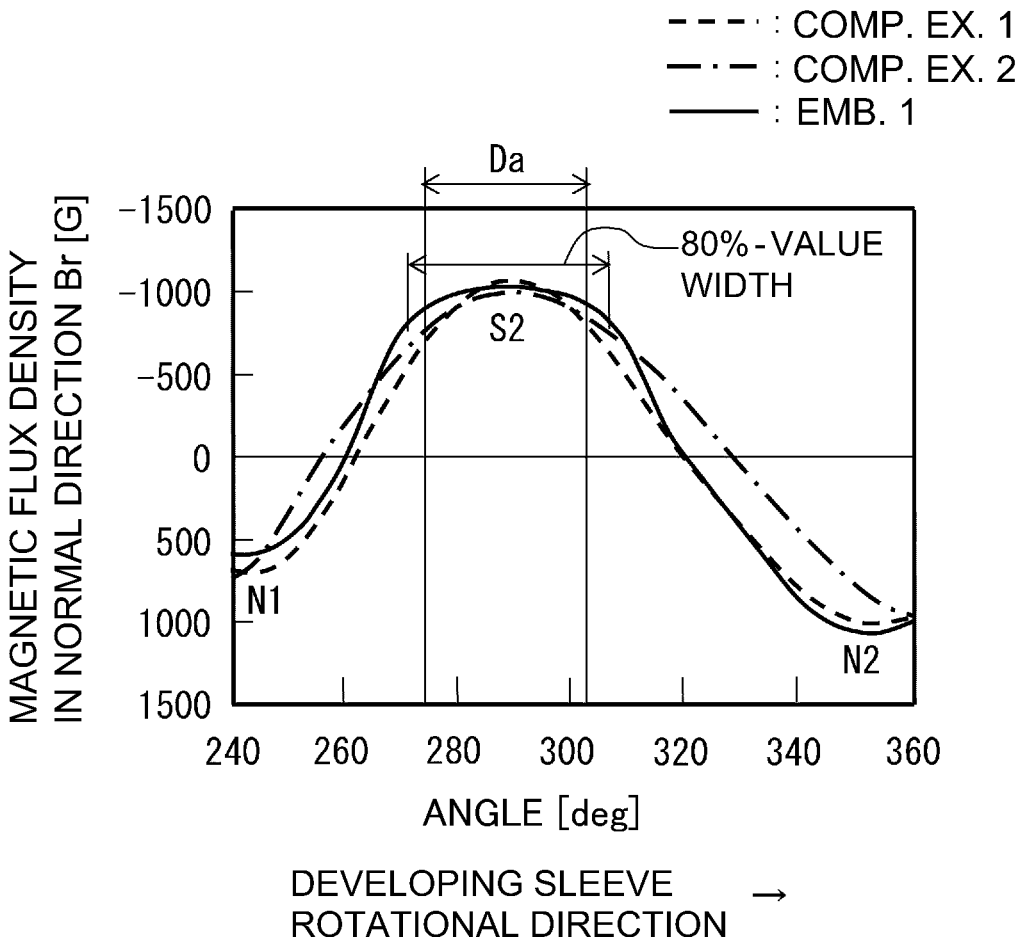
FIG. 3 is an illustration showing a relationship between an angle with a developing region of a developing sleeve as a center and magnetic flux density in normal direction according to Embodiment 1 and Comparison Examples 1 and 2.

The developing magnetic pole S2 in this embodiment has the magnetic flux density Br as shown in FIG. 3, and therefore, peaks of the magnetic attraction force Fr in a range from 260° to 320° are called peaks of the magnetic attraction force Fr of the developing magnetic pole S2. In the case of this embodiment, the developing magnetic pole S2 has two peaks of the magnetic attraction force Fr in the neighborhoods of 270° and 310°. Further, as regards the peaks of the magnetic attraction force, the peak on a downstream side with respect to the rotational direction is larger than the peak on an upstream side with respect to the rotational direction, and a lowest point exists at a position close to the upstream side with respect to the rotational direction between the peak on the upstream side with respect to the rotational direction and the peak on the downstream side with respect to the rotational direction. By this, the peak on the downstream side with respect to the rotational direction has a larger magnetic attraction force than the peak on the upstream side with respect to the rotational direction, so that carrier deposition on the photosensitive drum 81 on the downstream side with respect to the rotational direction can be suppressed.

Here, in this embodiment, a ratio between an 80%-value-width and a half-(value) width of the magnetic flux density Br with respect to a normal direction of the developing magnetic pole S2 to an outer peripheral surface of the developing sleeve 24 is 0.74, for example. On the other hand, a ratio between the 80%-value-width and the half peak width of the magnetic flux density which is a normal distribution is 0.60. The ratio between the 80%-value-width and the half peak width of the magnetic flux density Br with respect to the normal direction of the developing magnetic pole S2 to the outer peripheral surface of the developing sleeve 4 is larger than the ratio between the 80%-value-width and the half peak width of the magnetic flux density which is the normal distribution and is 0.65 or more (see, FIG. 3 and Table 1). Further, in this embodiment, the 80%-value-width of the magnetic flux density Br with respect to the normal direction of the developing magnetic pole S2 to the outer peripheral surface of the developing sleeve 24 is 35°, for example. On the other hand, a width of the developing Da with respect to the rotational direction is 28.6°. That is, the 80%-value-width of the magnetic flux density Br with respect to the normal direction of the developing magnetic pole S2 to the outer peripheral surface of the developing sleeve 24 is larger than the width of the developing region Da with respect to the rotational direction (see, FIG. 3). Incidentally, the half peak width of the magnetic flux density Br with respect to the normal direction of the developing magnetic pole S2 to the outer peripheral surface of the developing sleeve 24 is 40° or more. By these, also at an upstream portion and a downstream portion of the downstream Da, magnetic lines of force extend linearly toward the surface of the photosensitive drum 81. Therefore, free ends of the magnetic chains contact in a dot shape without extending along the surface of the photosensitive drum 1 (see, part (a) of FIG. 5), so that the toner can jump to the photosensitive drum 81 without being impaired by the magnetic chains from the developing sleeve 24 side (see, part (b) of FIG. 5).

Next, an operation of the developing sleeve in this embodiment will be described on the basis of FIG. 2. The developing sleeve 24 rotates in an arrow direction, and the developer accommodated in the developing chamber 21*b* is attracted by the scooping magnetic pole S1 opposing the developing chamber 21*b* and is fed toward the regulating member 25. The developer is erected by the regulating magnetic pole N1 opposing the regulating member 25, and a layer thickness thereof is regulated by the regulating member 25 and passes through a gap (spacing) between the developing sleeve 24 and the regulating member 25, so that a developer layer having a predetermined layer thickness is formed on the developing sleeve 24.

The developer layer is carried and fed to the developing region Da opposing the photosensitive drum 81 and develops the electrostatic latent image, formed on the surface of the photosensitive drum 81, in a state in which the magnetic chains are formed by the developing magnetic pole S2 opposing the developing region Da. That is, the developing magnetic pole S2 opposes the developing region Da of the developing sleeve 24 and erects the carrier carried in the developing region Da.

The developer after being subjected to the development (of the electrostatic latent image) passes through the feeding magnetic pole N2 disposed downstream of the developing region Da with respect to the rotational direction and is peeled off of the developing sleeve 24 in a peeling region formed by repulsion of the peeling magnetic pole S3 and the scooping magnetic pole S1 (pole). The peeled developer is stirred and fed in the stirring chamber 21*c* and then is supplied again from the developing chamber 21*b* to the developing sleeve 24.

As described above, according to the developing device 20 of this embodiment, the ratio between the 80%-value-width and the half peak width of the magnetic flux density Br with respect to the normal direction of the developing magnetic pole S2 to the outer peripheral surface of the developing sleeve 24 is larger than the ratio between the 80%-value-width and the half peak width of the magnetic flux density which is the normal distribution. For this reason, compared with the case where the developing region is increased by simply increasing the half peak width of the developing magnetic pole in the magnetic flux density which is the normal distribution. By this, also at an upstream portion and a downstream portion of the downstream Da, magnetic lines of force extend linearly toward the surface of the photosensitive drum 81. Therefore, free ends of the magnetic chains contact in a dot shape without extending along the surface of the photosensitive drum 1, so that the toner can jump to the photosensitive drum 81 without being impaired by the magnetic chains from the developing sleeve 24 side. Accordingly, while expanding the developing region Da, a lowering in developing efficiency by contact of the free ends of the magnetic chains with the photosensitive drum 81 can be suppressed.

Further, according to the developing device 20 of this embodiment, the developing magnetic pole S2 has only one peak of the magnetic flux density Br. For this reason, different from the case where in the developing region Da, two or more identical polarity peaks of the magnetic flux density Br are provided, the magnetic lines of force are not repelled between the identical polarity peaks of the magnetic flux density Br, and therefore, a portion where the magnetic chains are not readily formed due to repulsion of the magnetic lines of force does not generate. For this reason, the magnetic chains can be sufficiently formed, so that the developing efficiency can be improved.

Next, Embodiment 1 of the developing magnetic pole S2 of the magnet roller 24*m* in this embodiment will be described while being compared with Comparison Examples 1 and 2. First, the magnetic flux density Br of the developing magnetic pole S2 of the magnet roller 24*m* will be specifically described on the basis of FIG. 3. Here, an embodiment using the magnet roller 24*m* in this embodiment as the magnet roller 24*m* was Embodiment 1. Further, a comparison example using a magnet roller with a developing magnetic pole S2 narrow in half peak width was Comparison Example 1, and a comparison example using a magnet roller with a developing half peak width made broader than the half peak width in Comparison Example 1 was Comparison Example 2.

The magnetic flux density Br of each of the magnet rollers with respect to the normal direction of the developing magnetic pole S2 was measured with a magnetic field measuring device ("MS-9902", manufactured by F. W. BELL) with a distance, between a probe as a member of the magnetic field measuring device and the surface of the developing sleeve 24, of about 100 μm. In FIG. 3, a magnetic flux density (solid line) of the developing magnetic pole 2 in this embodiment as Embodiment 1, a magnetic flux density (dotted (chain) line), as Comparison Example 1, of the developing magnetic pole S2 narrow in half peak width, and a magnetic flux density (broken line), as Comparison Example 2, of the developing magnetic pole S2 having the half peak width made broader than the half peak width in Comparison Example 1 are shown. Here, the half peak width is a half peak width in which a width of a portion where (a normal component of) the magnetic flux density of the developing magnetic pole S2 is half (½) of a peak value is represented by an angle θ. In order to distinguish the half peak width from a half peak width at half maximum, the half peak width is called a full width at half maximum in some cases, but herein, the half peak width refers to the full width at half maximum. Further, the 80%-value-width is an 80%-value-width in which a width of a portion where (the normal component of) the magnetic flux density of the developing magnetic pole S2 is 80% of the peak value is represented by the angle θ. Similarly as in the case of the half peak width, the 80%-value-width simply referred to refers to a full width thereof.

Comparison Example 2 is a magnetic flux density distribution in the case where the half peak width is broadened by laterally broadening a shape of the magnetic flux density (distribution) of the developing magnetic pole S2 of Comparison Example 1 substantially analogously. On the other hand, in Embodiment 1, when the half peak width is broadened, the magnetic flux density (distribution) shape is not laterally expanded analogously as in Comparison Example 2, but is expanded so that the 80%-value-width is broadened more than the half peak width is.

Table 1 shows the half peak widths, the 80%-value-widths and values each obtained by dividing the 80%-value-width by the half peak width. As shown in Table 1, in Comparison Example 2, the half peak width is larger than the half peak width of Comparison Example 1, but the value obtained by dividing the 80%-value-width by the half peak width in Comparison Example 2 is not so changed from that in Comparison Example 1. This is because in Comparison Example 2, the half peak width is broadened by analogously expanding the magnetic flux density shape. On the other hand, in Embodiment 1, similarly as in Comparison Example 2, the half peak width is larger than the half peak width of the Comparison Example 1, but also the value obtained by dividing the 80%-value-width by the half peak width is larger than that in Comparison Example 1, and thus this point is a feature of Embodiment 1 different from Comparison Example 2.

TABLE 1

| | COMP. EX. 1 | COMP. EX. 2 | EMB. 1 |
|---|---|---|---|
| HW*1 [deg] | 38 | 47 | 47 |
| 80%-VW*2 [deg] | 23 | 28 | 35 |
| 80%-VW/HW*3 | 0.61 | 0.60 | 0.74 |

*1"HW" is the half peak width.
*2"80%-VW" is the 80%-value-width.
*3"80%-VW/HW" is the 80%-value-width/half peak width.

As a result, as shown in FIG. 3, the magnetic flux density distributions in Comparison Examples 1 and 2 have a shape that the magnetic flux density distributions gradually attenuated from the peaks of the developing magnetic poles S2, and on the other hand, the magnetic flux density distribution in Embodiment 1 had a shape that the magnetic flux density distribution was gentle and small in attenuation in the neighborhood of the peak, but abruptly attenuated when the position was a part from the peak (position).

As regards the ratio (80%-value-width/half peak width) between the 80%-value-width and the half peak width, in the case of the magnetic flux density distribution shape of an ordinary normal distribution type, the ratio is a value of about 0.60. In order to effectively suppress a lowering of developing efficiency due to the contact of the free ends of the magnetic chains with the photosensitive drum 81 while expanding the developing region Da, the 80%-value-width/half peak width may preferably be larger than 0.65, more preferably 0.66 or more, further preferably 0.70 or more. The 80%-value-width/half peak width in Embodiment 1 is 0.74, and therefore, the lowering of developing efficiency due to the contact of the free ends of the magnetic chains can be further effectively suppressed.

Figure 4:
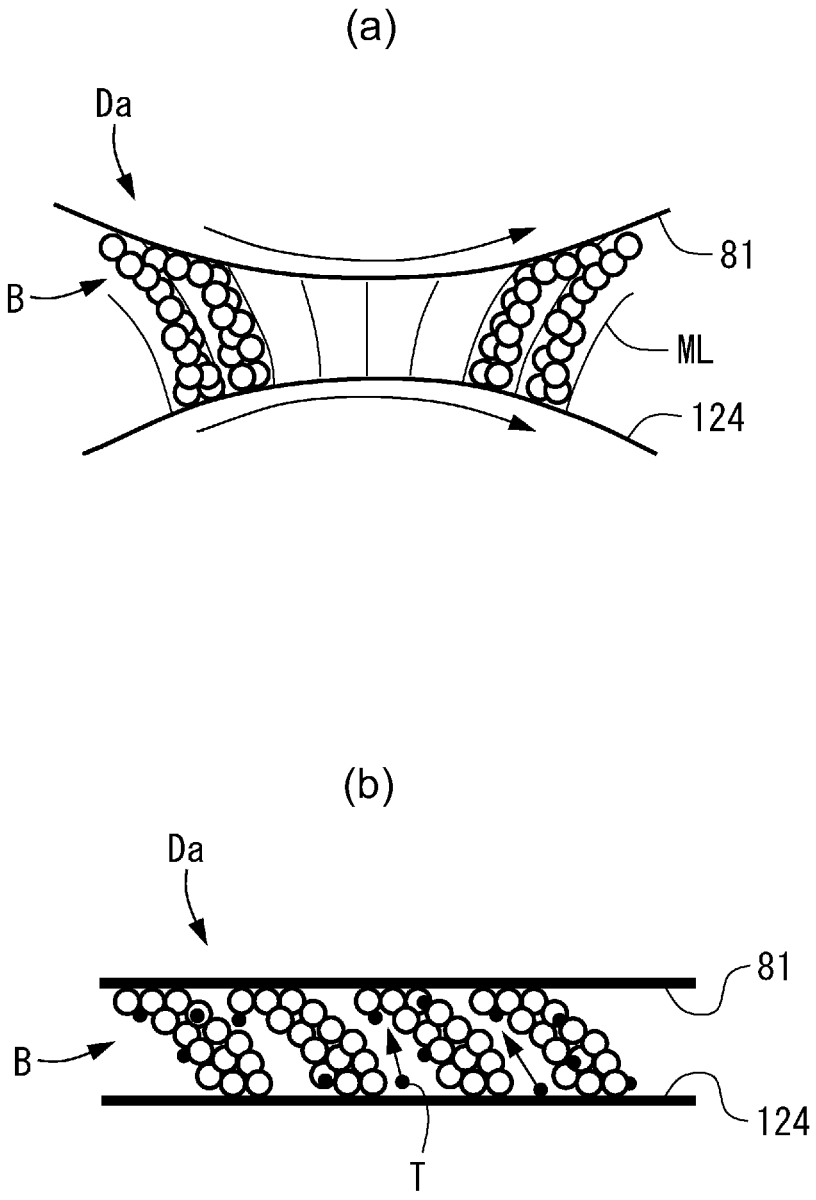
In FIG. 4, part (a) is an illustration showing a relationship between magnetic lines of force and magnetic chains in a developing region of a developing device according to Comparison Example 2, and part (b) is an enlarged view, on an upstream side with respect to a rotational direction of the developing sleeve, showing a state in which jumping of jump toward a photosensitive drum is impaired in the developing region of the developing device of Comparison Example 2.

Next, Embodiment 1 and Comparison Example 2 will be described on the basis of FIGS. 4 and 5 while comparing magnetic lines of force ML and shapes of magnetic chains B therebetween. In Comparison Example 2, as shown in part (a) of FIG. 4, the magnetic lines of force ML from a developing sleeve 124 extend from a center side while relatively broadening laterally. This is because the magnetic flux density distribution in Comparison Example 2 has a shape that the magnetic flux density distribution gradually attenuates from the peak and therefore the magnetic lines of force ML laterally broaden and easily extend along the photosensitive drum 81. An attitude of magnetic chains B follows the magnetic lines of force ML formed by the respective magnetic poles. In Comparison Example 2, the magnetic lines of force ML incline and extend relative to the surface of the photosensitive drum 81 and therefore free end portions of the magnetic chains B incline and contact the photosensitive drum 81 so as to cover the photosensitive drum 81. For that reason, as shown in part (b) of FIG. 4, the toner T in the neighborhood of the developing sleeve 124 is prevented from jumping toward the photosensitive drum 81, so that the developing efficiency lowers.

Figure 5:
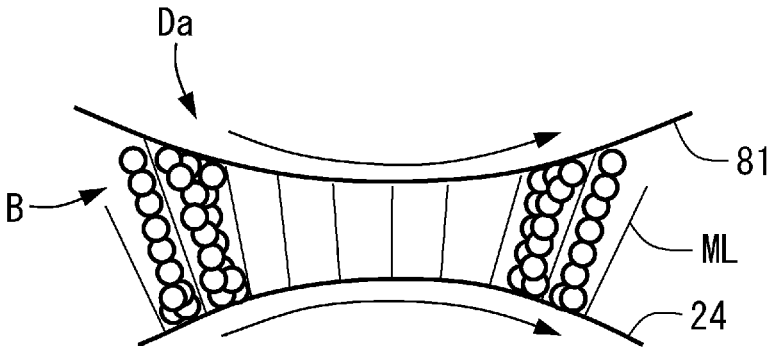
In FIG. 5, part (a) is an illustration showing a relationship between magnetic lines of force and magnetic chains in a developing region of a developing device according to Example 1, and part (b) is an enlarged view, on an upstream side with respect to a rotational direction of the developing sleeve, showing a state in which jumping of jump toward a photosensitive drum is carried out in the developing region of the developing device of Example 1.
Figure 5:
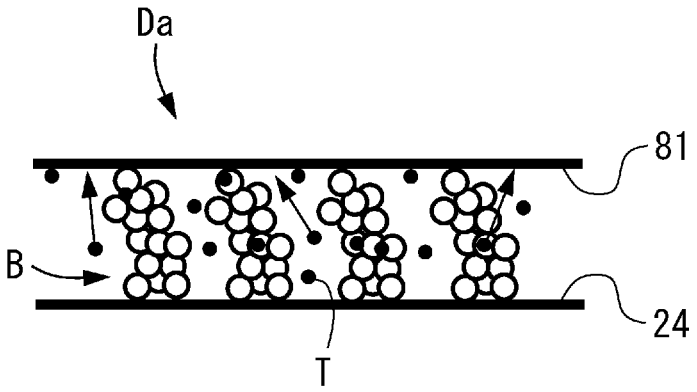

On the other hand, in Embodiment 1, as shown in part (a) of FIG. 5, the magnetic lines of force ML extend toward a direction of the photosensitive drum 81 relatively linearly. This is because the magnetic flux density distribution in Embodiment 1 has a shape that the magnetic flux density distribution is gentle and is not so changed and therefore the magnetic lines of force ML do not easily extend along the photosensitive drum 81. In Embodiment 1, the magnetic lines of force ML extend relatively straightly toward the surface of the photosensitive drum 81 and therefore free ends of the magnetic chains B extend toward the photosensitive drum 81. For that reason, the free ends of the magnetic chains B contact the surface of the photosensitive drum 1 in a point contact manner without extending along the surface of the photosensitive drum 81. By this, as shown in part (b) of FIG. 5, the toner T in the neighborhood of the developing sleeve 124 is not readily prevented from jumping toward the photosensitive drum 81, so that the developing efficiency can be improved. Incidentally, when an angle between the developing magnetic pole and each of upstream and downstream poles of the developing magnetic pole is 90° or more, the magnetic lines of force easily extend while relatively extending laterally from the center side. For that reason, the angle between the developing magnetic pole and each of the upstream and downstream poles of the developing magnetic pole may preferably be 90° or less. That is, the angle between a peak of the magnetic flux density of the developing magnetic pole S2 and a peak of the magnetic flux density of the regulating magnetic pole N1 is 90° or less, and the peak of the magnetic flux density of the developing magnetic pole S2 and a peak of the magnetic flux density of the feeding magnetic pole N2 is 90° or less. On both the upstream and downstream surfaces, the angles may preferably be 90° or less. The magnet roller 24*m* in this embodiment has peaks of the magnetic flux density corresponding to the five magnetic poles as described above, but the present invention is not limited to this constitution. However, in the case of a magnet roller having three magnetic poles, an angle between the developing magnetic pole and each of upstream and downstream poles of the developing magnetic pole tends to broaden, and does not readily satisfy the above condition. For that reason, the magnet roller 24*m* may preferably have magnetic poles which are five or more poles.

Further, also in the case where an absolute value of (a normal (line) component of) the magnetic flux density of the developing magnetic pole is small, the magnetic lines of force easily extend while relatively broadening laterally from the center side. For that reason, the absolute value (of the normal component of) the magnetic flux density of the developing magnetic pole may preferably be 90 mT or more, more preferably be 95 mT or more. Further, both the magnetic poles N1 and N2 upstream and downstream of the developing magnetic pole are not adjacent to an identical-polarity magnetic pole, but in the case where the upstream and downstream magnetic poles of the developing magnetic pole are adjacent to the identical-polarity magnetic pole, the magnetic lines of force of the developing magnetic pole easily extend while relatively broadening laterally from the center side. This is because the magnetic lines of force of the upstream and downstream magnetic poles of the developing magnetic pole do not readily extend in an identical-polarity direction in which the identical-polarity magnetic poles are adjacent to each other and extend while being deflected in the developing magnetic pole direction. Accordingly, both the upstream and downstream magnetic poles of the developing magnetic pole may preferably be not adjacent to the identical-polarity magnetic pole. In the case of the magnet roller consisting of the three magnetic poles, both the upstream and downstream magnetic poles of the developing magnetic pole are adjacent to the identical-polarity magnetic pole, and therefore, also in this respect, the magnet roller may preferably have magnetic poles which are five or more poles. By employing the above-described constitution, an effect of the present invention can be effectively obtained.

Further, in order to more effectively suppress the lowering in developing efficiency due to the contact of the free ends of the magnetic chains with the photosensitive drum 81, it is preferably that the free ends of the magnetic chains in the developing region Da can maintain an extending state thereof toward the photosensitive drum 81 to the extent possible. For that purpose, a change in (the normal component of) the magnetic flux density in the developing region Da may preferably be gentle and be not so changed. Therefore, by making a range of the 80%-value-width of (the normal component of) the developing magnetic pole broader than the developing region Da, the change in (the normal component of) the developing magnetic pole in the developing region Da can be made small. By this, the state in which the free ends of the magnetic chains extend toward the photosensitive drum 81 in the developing region Da can be maintained, so that the jump of the toner T in the neighborhood of the developing sleeve 24 toward the photosensitive drum 81 is not readily impaired and therefore the developing efficiency can be improved.

A width of the developing region Da with respect to the rotational direction can be measured in the following manner. In a state in which the developing device 20 is mounted on the photosensitive drum 81, rotation is stopped, and only a DC component of a developing voltage providing Vcont=300 [V] is applied to the developing sleeve 24. The reason why only the DC component is applied is that there is a liability that the toner jumps also from a portion other than the contact portion with the magnetic chains when an AC component (of the developing voltage) is applied and thus use of only the DC component is suitable for measuring only the contact portion. Further, at this time, the voltage application is carried out in a state in which the developing sleeve 24 and the photosensitive drum 81 are at rest. Thereafter, the developing device 20 is separated from the photosensitive drum 81, and a width of a range of deposition of the toner on the photosensitive drum 81 is measured and is used as a width of the developing region Da. Incidentally, in this embodiment, the developing region Da means a contact nip where the magnetic chains formed by the carrier on the surface of the developing sleeve 24 contact the photosensitive drum 81.

As a result of measurement of the width of the developing region Da, the width of the developing region Da was 5 mm. A diameter of the developing sleeve 24 is 20 mm, and therefore, when the width is converted into an angle on the surface of the developing sleeve 24, 5 mm×360°/20 mm×3.14)=28.6°. As shown in Table 1, the 80%-value-width of the developing sleeve 24 of Embodiment 1 is 35° and is larger than the width of the developing region da. By this, a state in which the free ends of the magnetic chains extend toward the photosensitive drum 81 in the developing region Da can be maintained and the jump of the toner T, in the neighborhood of the developing sleeve 24, toward the photosensitive drum 81 is not readily impaired, so that the developing efficiency can be improved.

Incidentally, both absolute values of the half peak width and the 80%-value-width are small, a region of the contact of the magnetic chains with the photosensitive drum 81 becomes narrow. For that reason, the half peak width may preferably be 36° or more, more preferably be 40° or more. Further, the 80%-value-width may preferably be 26° or more, more preferably be 30° or more.

Further, two or more identical-polarity peaks of the magnetic flux density Br are provided in the developing region Da, so that it is also possible to broaden the half peak width and the 80%-value-width, but in this case, the magnetic lines of force are repelled by each other between the identical-polarity peaks of the magnetic flux density Br, and therefore, the magnetic chains are not readily formed at that portion. When the portion where the magnetic chains are not readily formed generates, the developing efficiency lowers, so that it is preferable that the number of peaks of the magnetic flux density Br in the developing region Da is one.

Here, the contact state between the photosensitive drum 81 and the magnetic chains in the developing region Da would be considered as being largely related to a developer amount. For this reason, the present inventors observed a behavior of the developer in a close region between the photosensitive drum 81 and the developing sleeve 24 with a high-speed camera ("FASTCAM SA5", manufactured by Phortron Ltd.) from an inner surface of a transparent photosensitive drum 81 used for measurement. As a result, the following turned out.

The developing sleeve 24 is set in general so that a peripheral speed is faster than that of the photosensitive drum 81 in many cases. This is because the developing efficiency is improved with a larger peripheral speed ratio of the developing sleeve 24 to the photosensitive drum 81. However, when the peripheral speed ratio is excessively large, toner scattering, developer deterioration and the like generate, and therefore, the peripheral speed ratio is set at a value between 1.4 times and 2.1 times in many cases. In Embodiment 1, the peripheral speed ratio of the developing sleeve 24 to the photosensitive drum 81 is set at 1.8 times. In this embodiment, the rotational direction of the photosensitive drum 81 and the rotational direction of the developing sleeve 24 are opposite directions, and therefore, the peripheral speed of the developing sleeve 24 is 1.8 times the peripheral speed of the photosensitive drum 81.

Then, the present inventors observed the behavior of the developer in the close region between the photosensitive drum 81 and the developing sleeve 24 with regard to Comparison Example 2 and Embodiment 1, and calculated an (average) moving speed of the developer, moving on the surface of the photosensitive drum 81 in contact with the photosensitive drum 81, through PIV analysis. As in Embodiment 1, even in the case where the peripheral speed of the developing sleeve 24 is set at a value faster (higher) than a value of the peripheral speed of the photosensitive drum 81, the (average) moving speed of the developer is slower than the peripheral speed of the developing sleeve 24 in many instances. As a result of study by the present inventors, a degree of a speed down was small in Embodiment 1 compared with Comparison Example 2.

From this result, it became clear that in the case of Comparison Example 2 in which the half peak width of the developing magnetic pole was made large, the width of the developing region Da of the developer relative to the photosensitive drum 81 can be increased, while the moving speed of the developer contacting the surface of the photosensitive drum 81 lowers. For this reason, in Comparison Example 2, it would be considered that the developing efficiency was not so improved. On the other hand, in the case of Embodiment 1, it would be considered that the developing efficiency was improved since the width of the developing region Da of the developer relative to the photosensitive drum 81 is increased, and at the same time, the lowering in moving speed of the developer contacting the surface of the photosensitive drum 81 is also suppressed.

It would be considered that a difference in moving speed of the magnetic chains as described above closely relates to the magnetic attraction force Fr by which the developer is attracted to the center direction of the developing sleeve 24. When the magnetic attraction force Fr by which the developer is attracted to the center direction of the developing sleeve 24 is large, the magnetic chains are firmly constrained by the developing sleeve 24, and therefore, the magnetic chains do not readily slip on the developing sleeve 24, so that a lowering in speed of the magnetic chains can be suppressed. The magnetic attraction force Fr of the developing sleeve 24 is represented by the following formula 1.

$$F_r = \frac{\mu - \mu_0}{\mu_0(\mu + 2\mu_0)} 2\pi b^3 \left( B_r \frac{\partial B_r}{\partial r} + B_\theta \frac{\partial B_\theta}{\partial r} \right) \quad (1)$$

In the formula 1, μ is (magnetic) permeability, $\mu_0$ is space permeability, and b is a radius of the magnetic carrier. Bθ is acquired from the following formula 2 by using a value of Br measured by the above-described method.

$$B_\theta = -\frac{\partial A_z(r, \theta)}{\partial r} \quad \left( A_z(R, \theta) = \int_0^\theta R B_r d\theta \right) \quad (2)$$

In FIG. 6, the magnetic attraction force Fr, at a periphery of the developing region Da, calculated by the formulas 1 and 2 is shown. As shown in FIG. 6, in Comparison Example 2, there is a tendency that a magnitude of the magnetic attraction force Fr is smaller than that in Comparison Example 1 over an entirety of the developing region Da. This would be due to the following reason. That is, the magnetic attraction force Fr by which the developer is attracted to the center direction of the developing sleeve 24 is consisting of a product of a magnitude of the magnetic flux density and an r-direction change (partial differential) thereof. In Comparison Example 2, the magnetic flux density distribution has a shape such that the magnetic flux density gradually attenuates gently from a peak of the developing magnetic pole S2, so that the r-direction change of the magnetic flux density is also liable to become gentle. As a result, also the magnitude of the magnetic flux density becomes small with a distance from the peak and also the r-direction change (partial differential) thereof is liable to become small, and therefore, the magnetic attraction force Fr consisting of the product thereof is also liable to become small.

Figure 7:
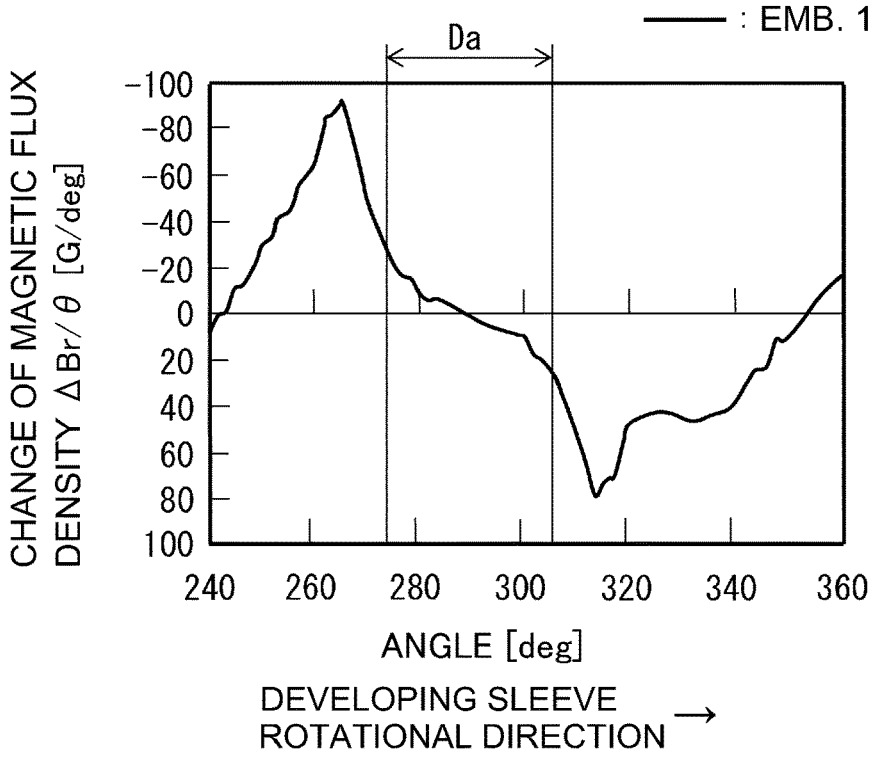
FIG. 7 is an illustration showing a relationship between the angle with the developing region of the developing sleeve as the center and a change of the magnetic flux density in the normal direction according to Embodiment 1.

On the other hand, in Embodiment 1, the magnetic attraction force Fr can be maintained at a high level in comparison with Comparison Example 2. This would be considered because the magnetic attraction force Fr is easily maintained at a large value correspondingly to that the magnetic flux density distribution is not so changed even when the associated portion is spaced from the peak of the developing magnetic pole S2 and the absolute value of the magnetic flux density can be maintained at a high level. Further, in a region spaced from the peak, the magnetic flux density abruptly attenuates, but in a region in which the magnetic flux density abruptly changes, the r-direction change (partial differential) thereof is also liable to become large, and therefore, the magnetic attraction force Fr can be maintained at the large value. In FIG. 7, an θ-direction change of the magnetic flux density Br in the case of Embodiment 1 was shown. When FIG. 6 and FIG. 7 are compared with each other, it is understood that at a portion where the θ-direction change of the magnetic flux density Br is large and provides a peak, also the magnetic attraction force Fr is large and provides a peak.

As described above, in Embodiment 1, the portion where the θ-direction change of the magnetic flux density Br is large and provides the peak is provided on each of sides upstream and downstream of the developing region Da with respect to the rotational direction, and also the peak of the magnetic attraction force Fr is provided on each of the sides upstream and downstream of the developing region Da with respect to the rotational direction. By this, the magnetic attraction force Fr can be maintained at the high level in the developing region Da. By this constitution, the absolute value of the magnetic flux density can be maintained at the high level in the developing region Da, so that the magnetic attraction force Fr is easily maintained at the large value, and outside the developing region Da, the magnetic flux density abruptly attenuates, but the magnetic attraction force Fr can be maintained at the high level because the magnetic flux density abruptly changes. Therefore, in Embodiment 1, the magnetic attraction force Fr can be maintained at the high level. As a result thereof, the magnetic chains are firmly constrained by the developing sleeve 24, and therefore, the magnetic chains do not readily slip on the surface of the developing sleeve 24, so that a lowering in speed of the magnetic chains can be suppressed.

Further, in Embodiment 1, the magnet roller 24*m* has a so-called D-cut shape in cross-section as a whole, and the magnetic piece including the developing magnetic pole S2 has a substantially sector shape in cross-section. The developing magnetic pole S2 includes the planar flat surface portion 24*s* opposing the developing region Da. The flat surface portion 24*s* is provided so as to be broader than the developing region Da (see, FIG. 2). The peak of the θ-direction change of the magnetic flux density Br and the peak of the magnetic attraction force Fr substantially coincide with each other at a position of each of the corner portions 24*c* formed at both edge portions of the flat surface portion 24*s* with respect to the rotational direction. This is because at the corner portions 24*c*, the magnetic lines of force concentrate, while also movement thereof along the photosensitive drum 81 generates. Accordingly, in order to realize the peak of the θ direction change of the magnetic flux density Br and the peak of the magnetic attraction force Fr which are shown in FIG. 6 and FIG. 7, the corner portions 24*c* may only be required to be provided on both sides upstream and downstream of the developing region Da with respect to the rotational direction on a surface of the magnetic piece on the photosensitive drum 81 side.

Further, in Embodiment 1, a constitution in which the peak of the magnetic attraction force Fr exists in the neighborhood of each of both sides upstream and downstream the developing region Da is employed. This peak has a value larger than a value at a central portion (center of the developing region Da) in the developing region. Particularly, the downstream-side peak is made larger than the upstream-side peak. Further, a position of the lowest point between the two peaks is a position close to the upstream side of the developing region Da. In this embodiment, a constitution in which the respective peaks are positioned outside the developing region D is employed, but a constitution in which the respective peaks are positioned within the developing region may also be employed.

By thus constituting the magnetic attraction force Fr, compared with the case where the magnetic attraction force Fr is constituted in an opposite manner, deposition of the carrier on the photosensitive drum 81 can be made hard to occur. That is, in the case where the downstream-side peak of the developing region Da is smaller than the upstream-side peak of the developing region Da and the position of the lowest point between the two peaks is a position close to the downstream side of the developing region Da, compared with Embodiment 1, the deposition of the carrier on the photosensitive drum 81 is liable to occur. Even when the carrier deposition occurs on the upstream side of the developing region Da, the deposited carrier can be collected on the downstream side, but the carrier deposition occurred on the downstream side cannot be collected at the periphery of the developing region Da. For that reason, a constitution in which occurrence of the carrier deposition is suppressed on the downstream side of the developing region Da may preferably be employed.

In order that the downstream-side peak of the magnetic attraction force Fr relative to the developing region Da is made larger than the upstream-side peak of the magnetic attraction force Fr relative to the developing region Da and the position of the lowest point between the two peaks is the position close to the upstream side of the developing region Da, for example, the following is carried out. That is, (normal direction component of) magnetic flux density Br of the feeding magnetic pole N2 on the side downstream of the developing magnetic pole S2 is made larger than (normal direction component of) magnetic flux density Br of the regulating magnetic pole N1 on the side upstream of the developing magnetic pole S2. By this, a change in magnetic flux density Br on the downstream side is large compared with the upstream side relative to the developing region Da, so that the magnetic attraction force Fr on the downstream side becomes large.

Or, in order that the downstream-side peak of the magnetic attraction force Fr relative to the developing region Da is made larger than the upstream-side peak of the magnetic attraction force Fr relative to the developing region Da and the position of the lowest point between the two peaks is the position close to the upstream side of the developing region Da, for example, magnetization may also be performed by the following method. Here, conventionally in general, as shown in part (a) of FIG. 8, with respect to a normal sector magnetic piece, the developing magnetic pole S2 is formed by performing magnetization so that magnetization vectors (indicated by arrows in the figure) are symmetrical (isotropic) with respect to an upstream-downstream direction. On the other hand, in this embodiment, as shown in part (b) of FIG. 8, with respect to a normal sector magnetic piece, the developing magnetic pole S2 is formed by performing magnetization so that magnetization vectors (indicated by arrows in the figure) are asymmetrical (anisotropic) with respect to an upstream-downstream direction, so that the magnetic attraction force Fr on the downstream side can be made large. Specifically, the magnetization may only be required to be performed so that the magnetization vectors of the magnetic piece alone extend in a downstream direction. In other words, when in a circumferential component of the developing sleeve 24, the downstream side with respect to the rotational direction of the developing sleeve 24 is a positive side, the magnetization may only be required to be performed so that with respect to the sum of the magnetization vectors of the magnetic piece alone, the circumferential component is a positive component.

In the present invention, the magnetic attraction force Fr of the carrier has the two peaks, but in order to suppress the carrier deposition, the absolute value of the lowest point between the above two peaks of the magnetic attraction force Fr of the carrier may preferably be $1.0\times10^{-7}$ N or more. Further, also the peak of the magnetic attraction force may preferably be $1.5\times10^{-7}$ N or more, more preferably be $2.0\times10^{-7}$ N or more. In order to make the magnetic attraction force Fr of the carrier large, other than an increase of an absolute value of Br of the magnetic piece, the magnetic attraction force can be improved (increased) by a carrier characteristic such that a magnetic characteristic of the carrier is high magnetization or such that an average particle size is made large.

Next, Embodiment 2 regarding the developing magnetic pole S2 of the magnet roller 24*m* in this embodiment will be described while making a comparison with Embodiment 1 as shown in FIG. 6. An outline of the image forming apparatus 1 and the developing device 20 is similar to that of Embodiment 1, and therefore will be omitted from detailed description. As shown in FIG. 6, in Embodiment 2, compared with Embodiment 1, a distribution of the magnetic attraction force Fr of the developing magnetic pole S2 is different.

That is, in Embodiment 1, in the constitution in which the peak of the magnetic attraction force Fr exists on each of both sides upstream and downstream of the developing region Da, particularly, the downstream-side peak was made larger than the upstream-side peak. Further, the position of the lowest point between the two peaks was the position close to the upstream side of the developing region Da. This is because the carrier deposition (matter) generating at the lowest point of the magnetic attraction force Fr is collected on the downstream surface. On the other hand, in Embodiment 2, a constitution in which the upstream-side peak of the magnetic attraction force Fr was larger than the downstream-side peak of the magnetic attraction force Fr was employed. That is, the peak of the magnetic attraction force Fr is larger on the upstream side with respect to the rotational direction than on the downstream side with respect to the rotational direction, and the magnetic attraction force Fr has a lowest point, close to the downstream side with respect to the rotational direction, between the upstream-side peak with respect to the rotational direction and the downstream-side peak with respect to the rotational direction.

As described above, an increase in magnetic attraction force Fr at the upstream-side peak more than at the downstream-side peak has the following merit (advantage). First, when the magnetic attraction force Fr is large, the magnetic chains are firmly constrained, and therefore, the magnetic chains do not readily slip on the surface of the developing sleeve 24, so that a lowering in speed of the magnetic chains can be suppressed. According to study by the present inventors, the lowering in speed of the magnetic chains is liable to occur on the upstream side of the developing region Da in general. This is because on the upstream side, a gap (interval) between the developing sleeve 24 and the photosensitive drum 81 gradually narrows, so that the speed of the magnetic chains lowers on the upstream side so as to cause a delay due to a bottleneck. On the other hand, on the downstream side, the gap between the developing sleeve 24 and the photosensitive drum 81 gradually broadens, and therefore, the lowering in speed of the magnetic chains as on the upstream side does not readily occur. Accordingly, the lowering in speed of the magnetic chains on the upstream side can be more suppressed by making the upstream-side peak large. Similarly, the position of the lowest point between the two peaks of the magnetic attraction force Fr is changed to a position close to the downstream side of the developing region Da, so that a similar effect can be obtained.

As a magnetizing method for obtaining the distribution of the magnetic attraction force Fr as in Embodiment 2, a method similar to the method described in Embodiment 1 can realize the magnetic attraction force distribution. Specifically, (normal direction component of) magnetic flux density Br of the regulating magnetic pole N1 on the side upstream of the developing magnetic pole S2 is made larger than (normal direction component of) magnetic flux density Br of the feeding magnetic pole N2 on the side downstream of the developing magnetic pole S2. Or, anisotropic magnetization may only be required to be performed so that magnetization vectors are more oriented in an upstream direction. Incidentally, whether the downstream peak of the magnetic attraction force Fr is increased for the purpose of carrier deposition suppression on the downstream side as in Embodiment 1 or the upstream peak of the magnetic attraction force Fr is increased for the purpose of suppression of the lowering in speed of the magnetic chains on the upstream side as in Embodiment 2 is appropriately selectable. The selection of Embodiments 1 and 2 in the case can be appropriately made depending on, for example, specifications required for a product.

Incidentally, the developing magnetic pole S2 in Embodiment 1 included the planar flat surface portion 24*a* opposing the developing region Da. However, in order to obtain the effect of the present invention, the shape of the developing magnetic pole S2 is not limited to such a shape. Even when the piece having the substantially sector shape in cross-section as in the conventional constitution is used as it is, the magnetic flux density characteristic as in the present invention can be obtained by a device (contrivance) during the magnetization. The conventionally general magnetizing method is, as shown in FIG. 9, a method in which an orientation yoke 91 is brought near to a magnetic piece 24 having the substantially sector shape and thus the magnetic piece 24 is magnetized and oriented. At this time, the magnetic flux density characteristic as in the present invention can be obtained by more broadening a width (arrow in the figure) of a free end of the orientation yoke 91 contacting the magnetic piece 24. Particularly, the width of contact of the free end of the orientation yoke 91 with the magnetic piece 24 may preferably be made larger than the width of the developing region Da. In order to obtain the effect with reliability even when some run-out generates, the width of contact of the free end of the orientation yoke 91 with the magnetic piece 24 may preferably be made not less than 1.1 times, preferably not less than 1.2 times, the width of the developing region Da. As described above, even in the substantially sector shape in cross-section, when the magnetic piece has the magnetic flux density characteristic as in the present invention, the effect of the present invention can be obtained.

Further, in the above-described embodiment, the DC developing type was described, but a similar effect can be obtained even when the present invention is used for a developing device of an AC+DC developing type in which a DC voltage is biased (superposed) with an AC voltage.

INDUSTRIAL APPLICABILITY

According to the present invention, it is possible to provide a developing device in which a lowering in developing efficiency is suppressed by controlling a state of contact of free ends of magnetic chains with a photosensitive drum even while expanding a developing region.

EXPLANATION OF SYMBOLS

20 . . . developing device, 24 . . . developing sleeve, 24*c* . . . corner portion, 24*s* . . . flat surface portion, 24*m* . . . magnet roller (magnetic field generating means), 81 . . . photosensitive drum (image bearing member), Da . . . developing region, S2 . . . developing magnetic pole, T . . . toner.

The invention claimed is:

1. A developing device comprising:

a rotatable developing sleeve configured to carry and feed a developer including toner and a carrier toward a developing region where an electrostatic latent image formed on an image bearing member is developed with the developer; and a magnetic field generating portion provided inside said developing sleeve and having a developing magnetic pole, the developing magnetic pole being disposed opposite to a closest position of said image bearing member to said developing sleeve, wherein a ratio of an 80%-value-width of magnetic flux density of the developing magnetic pole with respect to a normal direction of said developing sleeve to a half peak width of the magnetic flux density of the developing magnetic pole with respect to the normal direction is 0.65 or more, wherein a magnetic force of the developing magnetic pole in the normal direction of said developing sleeve proximate to an upstream end portion of the developing region with respect to the rotational direction of said developing sleeve is larger than a magnetic force of the developing magnetic pole in the normal direction of said developing sleeve at a center portion of the developing region with respect to the rotational direction of said developing sleeve, with a peak position of the magnetic force of the developing magnetic pole in the normal direction of said developing sleeve proximate to the upstream end portion of the developing region with respect to the rotational direction of said developing sleeve being positioned outside of the developing region with respect to the rotational direction of said developing sleeve, and wherein a magnetic force of the developing magnetic pole in the normal direction of said developing sleeve proximate to a downstream end portion of the developing region with respect to the rotational direction of said developing sleeve is larger than the magnetic force of the developing magnetic pole in the normal direction of said developing sleeve at the center portion of the developing region with respect to the rotational direction of said developing sleeve, and a peak position of the magnetic force of the developing magnetic pole in the normal direction of said developing sleeve proximate to the downstream end portion of the developing region with respect to the rotational direction of said developing sleeve being positioned outside of the developing region with respect to the rotational direction of said developing sleeve.

2. A developing device according to claim 1, wherein the 80%-value-width of the magnetic flux density of the developing magnetic pole with respect to the normal direction of said developing sleeve is broader than a width of the developing region with respect to the rotational direction of said developing sleeve.

3. A developing device according to claim 1, wherein the ratio between the 80%-value-width of the magnetic flux density of the developing magnetic pole with respect to the normal direction of said developing sleeve and the half peak width of the magnetic flux density of the developing magnetic pole with respect to the normal direction is 0.70 or more.

4. A developing device according to claim 1, wherein the half peak width of the magnetic flux density of the developing magnetic pole with respect to the normal direction of said developing sleeve is 40° or more.

5. A developing device according to claim 1, wherein a peak value of the magnetic force of the developing magnetic pole in the normal direction of said developing sleeve downstream of the developing region with respect to the rotational direction of said developing sleeve is larger than a peak value of the magnetic force of the developing magnetic pole in the normal direction of said developing sleeve upstream of the developing region with respect to the rotational direction of said developing sleeve.

6. A developing device according to claim 1, wherein a peak value of the magnetic force of the developing magnetic pole in the normal direction of said developing sleeve upstream of the developing region with respect to the rotational direction of said developing sleeve is larger than a peak value of the magnetic force of the developing magnetic pole in the normal direction of said developing sleeve downstream of the developing region with respect to the rotational direction of said developing sleeve.

7. A developing device according to claim 1, wherein a peak value of the magnetic force of the developing magnetic pole in the normal direction of said developing sleeve upstream of the developing region with respect to the rotational direction of said developing sleeve is $1.5\times10^{-7}$ N or more, and a peak value of the magnetic force of the developing magnetic pole in the normal direction of said developing sleeve downstream of the developing region with respect to the rotational direction of said developing sleeve is $1.5\times10^{-7}$ N or more.

8. A developing device according to claim 1, wherein a peak value of the magnetic force of the developing magnetic pole in the normal direction of said developing sleeve upstream of the developing region with respect to the rotational direction of said developing sleeve is $2.0\times10^{-7}$ N or more, and a peak value of the magnetic force of the developing magnetic pole in the normal direction of said developing sleeve downstream of the developing region with respect to the rotational direction of said developing sleeve is $2.0\times10^{-7}$ N or more.

9. A developing device according to claim 1, wherein a lowest point of the magnetic force of the developing magnetic pole in the normal direction of said developing sleeve between a peak position of the magnetic force of the developing magnetic pole in the normal direction of said developing sleeve upstream of the developing region of said developing sleeve and a peak position of the magnetic force of the developing magnetic pole in the normal direction of said developing sleeve downstream of the developing region of said developing sleeve is in the developing region.

10. A developing device according to claim 1, wherein a magnetic field generating portion includes a plurality of magnetic poles including the developing magnetic pole, and wherein the number of the plurality of magnetic poles is five.

11. A developing device according to claim 1, further comprising a voltage source configured to apply a DC voltage to said developing sleeve, wherein the electrostatic latent image formed on the image bearing member is developed by applying the DC voltage to said developing sleeve without applying an AC voltage to said developing sleeve.

* * * * *